US005507679A

United States Patent [19]

Getsay

[11] Patent Number: 5,507,679

[45] Date of Patent: Apr. 16, 1996

[54] TOY VEHICLE SYSTEM AND ASSOCIATED VEHICLE

[76] Inventor: James G. Getsay, 125 Zeigler Dr., Harmony, Pa. 16037

[21] Appl. No.: 295,292

[22] Filed: Aug. 24, 1994

[51] Int. Cl.[6] ..... A63H 18/00; A63H 30/02; A63H 21/02

[52] U.S. Cl. ..... 446/444; 446/455; 446/229; 104/138.1; 104/126; 104/119; 105/30

[58] Field of Search ..... 446/444, 495, 446/446, 447, 448, 454, 455, 470, 471, 228, 229, 179; 104/138.1, 126, 119, 93, 245, 246, 295, 305; 105/30, 144, 165

[56] References Cited

U.S. PATENT DOCUMENTS

| | | | |
|---|---|---|---|
| 146,033 | 12/1873 | Tillman . | |
| 1,074,283 | 9/1913 | Morgan . | |
| 1,482,641 | 2/1924 | Fergusson et al. . | |
| 1,865,277 | 6/1932 | Rosenthal . | |
| 2,581,583 | 1/1952 | Fields . | |
| 2,876,952 | 3/1959 | Washabaugh . | |
| 2,913,997 | 11/1959 | Wolf | 105/30 X |
| 3,041,983 | 7/1962 | Liversidge et al. | 104/93 |
| 3,069,805 | 12/1962 | Burrows . | |
| 3,115,845 | 12/1963 | Girz | 104/119 |
| 3,343,793 | 9/1967 | Waser . | |
| 3,391,490 | 7/1968 | Evans | 446/455 |
| 3,500,581 | 3/1970 | Lemelson . | |
| 3,630,153 | 12/1971 | Gulmarin . | |
| 3,796,164 | 3/1974 | Nogi et al. . | |
| 3,889,605 | 6/1975 | Bacon | 104/246 X |
| 4,231,294 | 11/1980 | Arzoumanian . | |
| 4,606,732 | 8/1986 | Lyman | 446/128 X |
| 4,632,038 | 12/1986 | Lawrence . | |

FOREIGN PATENT DOCUMENTS

| | | | |
|---|---|---|---|
| 535515 | 12/1958 | Belgium | 446/444 |
| 1813995 | 12/1969 | Germany | 104/138.1 |
| 2129318 | 5/1984 | United Kingdom | 446/444 |
| 2154152 | 9/1985 | United Kingdom | 446/471 |

*Primary Examiner*—Mickey Yu
*Assistant Examiner*—S. Neal Muir
*Attorney, Agent, or Firm*—Arnold B. Silverman; Eckert Seamans Cherin & Mellott

[57] ABSTRACT

A toy vehicle system has a vehicle provided with a resiliently biased driven wheel. The wheel is driven by a motor and interposed gears for rotating said driven wheel. The driven wheel is in contact with a lateral side of the track. The motor and driven wheel are mounted on a panel which is positioned for relative movement within a slot in the vehicle pedestal. Track engaging elements, which may preferably be spools, have a pair of rotatable elements in engagement with each side of the track. A pair of resiliently biased electrical pickups is disposed in contacting relationship with the electrically energized track rails. One or more lights may be provided on the vehicle. The vehicle is preferably disposed within a closed hollow enclosure. A feature of the present invention is the ability of the vehicle to move efficiently regardless of whether the track is oriented horizontally, vertically, at intermediate angles, inverted or twisted, and also regardless of whether the track has portions of different elevation from other portions. The vehicle may have a pedestal composed of two or more relatively rotatable sections. The vehicle for use in the toy vehicle system is also disclosed.

49 Claims, 9 Drawing Sheets

TOY VEHICLE SYSTEM AND ASSOCIATED VEHICLE

BACKGROUND OF THE INVENTION

1. Field of the Invention

The present invention relates to a unique toy vehicle system wherein the vehicle is firmly secured to a track and may be driven efficiently on the track even though the track may be oriented vertically, horizontally, inverted, twisted or have paths of varying configuration such as curves or changes in elevation.

2. Description of the Prior Art

Children have long enjoyed playing with unpowered toy-sized vehicles such as cars, trucks, and military vehicles. It has been known to provide movement of toy vehicles or other items on a defined path under the influence of gravity. See U.S. Pat. Nos. 1,865,277, 3,069,805 and 3,343,793. It has also been known to provide vehicles which operate on a track and are powered by a wind-up type spring mechanism. See U.S. Pat. 2,581,583, for example, which also discloses the use of a projecting arm which is engaged within a groove so as to resist undesired separation of the vehicle from the track.

Children and adults have long enjoyed the benefits of electrically energized model trains which run on a track assembled from individual component track sections and are electrically energized through a conventional wall outlet with an electrically interposed transformer. In such system, the electrical energy is delivered to the train through the tracks. It has been known to employ a third rail to energize trains which trains carry an electrical pick-up shoe adjacent to the driven wheels. See, generally, U.S. Pat. No. 1,482,641.

It has also been known, in connection with model trains, to provide friction enhancing means adjacent to electrically non-conductive wheels.

U.S. Pat. No. 4,632,038 discloses a monorail-type toy vehicle wherein power is delivered to the motor through to relatively offset wheel contacts.

U.S. Pat. No. 3,630,153 discloses a mass transit system which is energized by a linear induction motor and has a pair of wheels in interengagement with underlying track members. The concrete base and shroud serve to provide an enclosure. See also U.S. Pat. No. 1,074,283.

U.S. Pat. No. 3,500,581 discloses a toy wherein the track is made from a plastic sheet and has slots for electrical contact and flanges to assist with retention of the vehicle on the track.

U.S. Pat. No. 4,231,294 discloses a toy train which is adapted to travel within a tubular structure consisting of a base and an overlying cover member. Adjacent sections of the track are joined by interlocking action. See, also, U.S. Pat. No. 2,876,952 and 3,796,164.

None of the prior art systems disclose any construction wherein a vehicle is able to move along a track in a powered manner, regardless of whether the track is horizontally oriented, vertically oriented, angularly oriented, twisted or curved in a vertical sense, or otherwise departs from generally horizontal travel. There is further lacking in the prior art any teaching or suggestions of resiliently maintained driving contact between a toy vehicle and the track.

SUMMARY OF THE INVENTION

The present invention has met the foregoing needs by providing a toy vehicle system wherein electrically energized track means are assembled from a plurality of sections and appropriate power means serve to deliver electrical energy to the vehicle means. The vehicle means has plurality of idler type track engaging means which serve to engage lateral sides of the track. The track engaging means may take the form of spool means which consist of a pair of spaced spools engaging each side of the track means. A resiliently biased driven wheel, which is preferably interposed between a pair of track engaging means on the same side of the track, is rotatably driven by a motor carried on the vehicle. Electrical pickup means are preferably resiliently biased and disposed laterally interiorly of the track engaging means.

The vehicle has a pedestal provided with the track engaging means, a resiliently biased driven wheel, and electrical pickup means, all depending downwardly from the pedestal. This pedestal is provided with a slot within which a panel moves laterally. The driven wheel is fixedly secured to a shaft which is rotatably housed in the panel, and terminates in the gear means, which are engaged with gear means fixedly secured to the output shaft of the motor. The motor is secured to the upper side of the movable panel. As the motor is energized and rotates, it will drive the driven wheel with the contact being intimate due to the resilient biasing action.

A closed, hollow path is preferably provided around the track such that the vehicle may move in a closed path. The vehicle may be energized by (a) an electrical outlet with a suitable transformer, (b) under the influence of a 9 volt battery, or (c) by other suitable means. Numerous arrangements of track assemblies and enclosures may be provided. The vehicle will move efficiently regardless of orientation of the entire track assembly or a portion thereof being vertical, horizontal, inverted, or curved, or combinations thereof or the track being twisted.

It is an object of the present invention to provide a toy vehicle system which will provide for effective track engagement by the vehicle and efficient retention and driving of the same regardless of orientation of the track assembly.

It is a further object of the present invention to provide such a system wherein the tracks and vehicle may be positioned within a hollow closed path.

It is a further object of the present invention to provide such a system wherein a variety of track contours, elevations, and orientations may be employed without interfering with efficiency and speed of movement of the vehicle.

It is a further object of the present invention to provide such a system which facilitates creative challenge for the user by permitting a wide variety of assemblies with different track path configurations and orientations.

It is another object of the invention to provide a system which permits ready handling and movement of the assembly to a different location or orientation without requiring disassembly and reassembly.

It is another object of the invention to provide for illumination of vehicle in combination with translucent hollow enclosure sections.

It is a further object of the present invention to provide such a system which is economical to produce and safe to use.

These and other objects of the invention will be more fully understood from the following description of the invention on reference to the illustrations appended hereto.

BRIEF DESCRIPTION OF THE DRAWINGS

FIG. 5(*a*) is a detail of a portion of FIG. 5 showing the slot configuration.

DESCRIPTION OF THE PREFERRED EMBODIMENT

Figure 1:
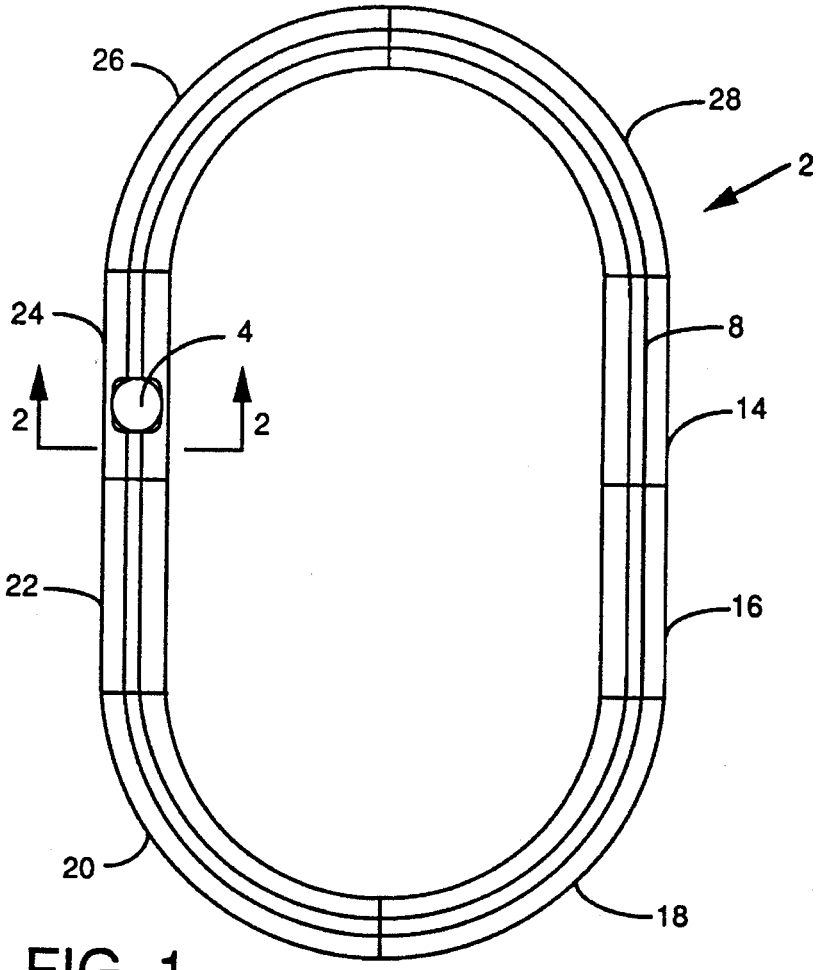
FIG. 1 is a partially schematic elevational view of one form of vehicle and track assembly of the present invention shown with the closed track being oriented generally vertically.

Referring now more specifically to FIG. 1, there is shown a track assembly 2 which is oriented vertically in much the same matter as a clock would be hung on a wall with a vehicle 4 at approximately the 10:00 o'clock position. The vehicle 2, in a manner which will be hereinafter described, is movably secured to track means 8 which are confined within a tubular closed system comprised of a series of removably joined tubular elements 14, 16, 18, 20, 22, 24, 26, and 28 which are interengaged in end to end securement to each other in a manner to be discussed hereinafter. It will be noted that some of the individual portions, in the form shown, have different axial configurations. The longitudinal axis of sections 26 and 28 are, for example, curved concavely inwardly as are the longitudinal axes of sections 18, 20. The vehicle 4 is adapted to be secured in any position and, when electrically energized, will move at the desired speed without regard to the configuration or orientation of the track assembly.

Figure 2:
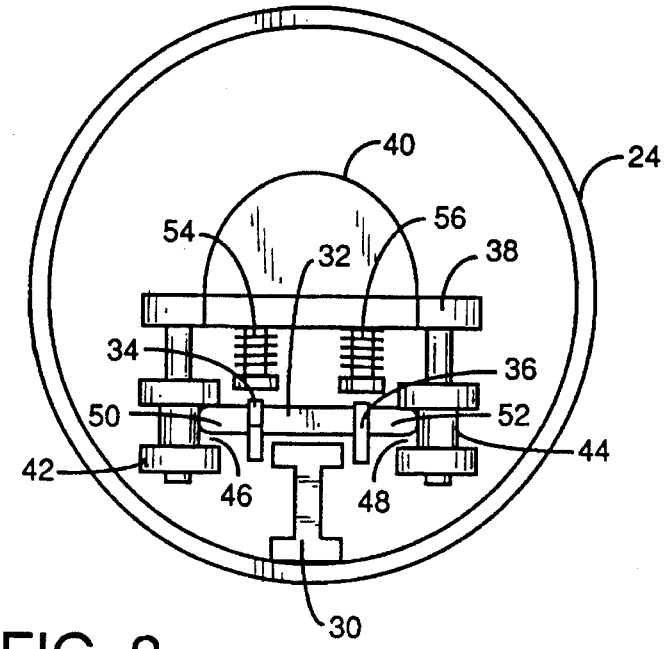
FIG. 2 is a cross-sectional illustration of the track and the vehicle taken through 2—2 of FIG. 1.

Referring to FIG. 2 which shows a tubular section, it will be noted that the track enclosure section 24 is, in the form shown, generally tubular and unitary in construction. It may be composed of plastic, for example, which may advantageously be either transparent or translucent so as to facilitate viewing of the vehicle 2 as it moves in its orbit. The tubular sections preferably have an internal diameter of about 2 to 4 inches. If desired, different sections of the track may be of different colors so as to create an attractive, aesthetic effect when the vehicle, which is illuminated, moves through various sections. A generally I-beam shaped support 30 has a lower portion secured to the inner surface of tubular sections 24 and has track means 32 secured to its upper flange. Track means 32, in the form shown, have a pair of electrically conductive track rails 34, 36 which present an upwardly projecting electrically conductive edges. The overlying vehicle has a pedestal 38 with a dome-like cover 40 which may advantageously be secured to the vehicle in any desired manner. Depending downwardly from the pedestal 38 and mounted rotatably with respect to a fixed shaft depending therefrom are a pair of track engaging means 42, 44 which are generally spool-shaped and have recesses respectively 46, 48 within which the lateral sides 50, 52 of the track are received. Depending from the pedestal 38 are a pair of spring biased electrical contact means 54, 56 which are adapted to engage rails 34, 36. respectively, in order to energize the vehicle.

Figure 3:
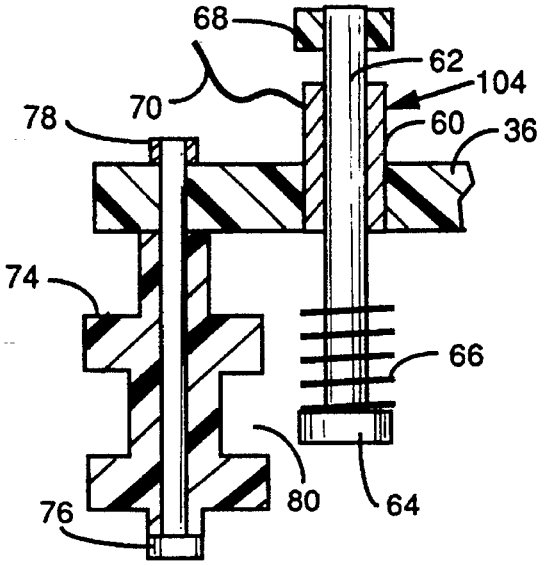
FIG. 3 is a partial cross-sectional illustration showing a form of electrical contact means and track engaging means.

Referring now to FIG. 3, there is shown the pedestal 36 through which is passing an electrically conductive tubular member 60 which is fixedly secured thereto. The electrical contact member has a shaft 62 which is in intimate contact with the interior of member 60 such that electric current will pass from shaft 62 to tubular member 60. At the lower end of shaft 62 is an enlarged head portion 64, the lower surface of which will engage a track rail to receive energy therefrom. A coil spring 66 urges the head 64 downwardly into intimate contact with the rail. An enlarged upper head 68 is provided in order to insure retention of the contact means within the tube 60. In this manner, electrically conductive wires, such as wire 70, may be secured to the outside of electrically conductive tubular member 60 so as to distribute electricity received through the track rail and electrical contact member or pickup. The resiliently biased contacts also function as shock absorbers for the vehicle. This feature is particularly helpful when the vehicle is descending into a dip before changing to a horizontal or vertical direction.

Shown to the left of the electrical pickup in FIG. 3 is a spindle 74 which is axially rotatably mounted with respect to shaft 76 which passes through pedestal 36 and is secured thereto by enlarged upper head 78. The spindle 74 is an idler spindle and is adapted to engage a lateral side of the track within recess 80 so as to enhance securement of the vehicle to the track. In a preferred embodiment of the invention, as will be described hereinafter, a pair of spaced spools are provided on each side of the track for interengagement with the track. Recess 80 preferably has an axial height equal to about 1½ to 2½ times the thickness of the lateral side of the track. Similarly, a pair of spaced electrical pickups are provided for each track rail in order to ensure continuity of electrical supply.

Figure 4:
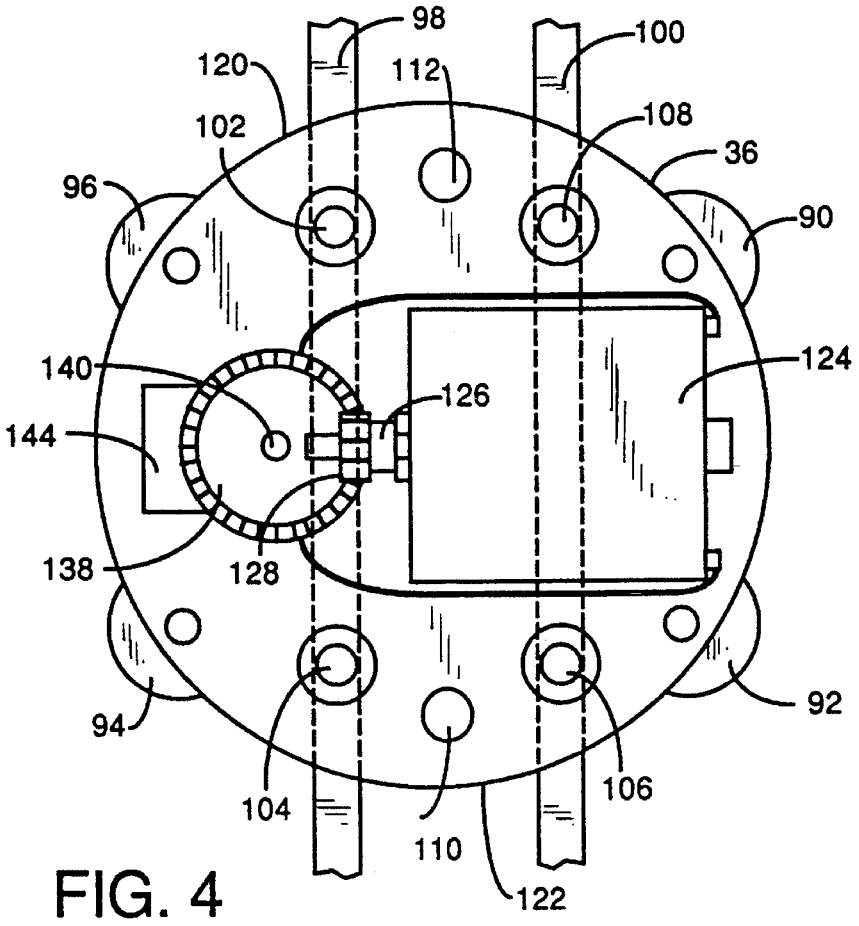
FIG. 4 is a top plan view of a form of vehicle of the present invention.

FIG. 4 is a top plan view which shows the pedestal 36 and portions of four spools 90, 92, 94, 96. The track rails 98, 100 which would underlie electrical pickups 102, 104, 106, 108, respectively, are shown in dotted line fashion. Wires (not shown in this view) will connect the upper portion of sleeve 60 (FIG. 3) with the motor and, in the form shown, a pair of light bulbs 110, 112. Suitable bulbs are those sold under the designation Life-Like Trains No. 1210 by Life-Like Products of Baltimore, Md. These bulbs will be energized through wires connected to the electrical pickup and illuminate, respectively, the rear 120 and front 122 of the vehicle.

The electric motor 124 has an output shaft 126 to which is attached first gear means 128 in the form of a pinion gear. This will cooperate with second gear means 138 which, in the form shown, is a crown gear. Gear means 138 is secured to shaft 140 which, in turn, is fixedly secured to the driven wheel, which will be described hereinafter. The gears 128, 138 function as speed reduction gears. It will be appreciated that the motor output shaft 126 is oriented generally transversely of the vehicle.

Figure 5:
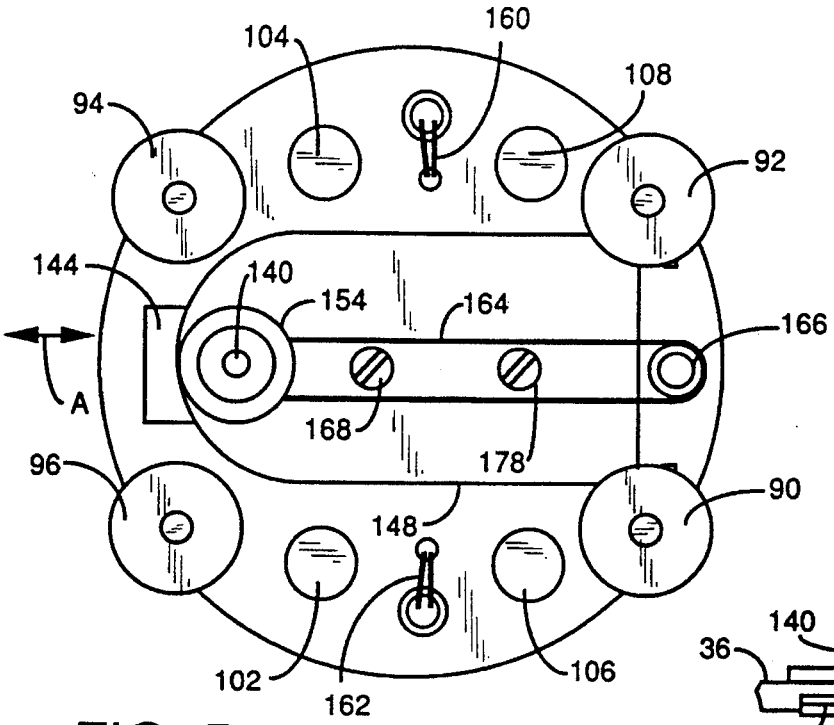
FIG. 5 is a bottom plan view of a form of vehicle of the present invention.
Figure 5A:
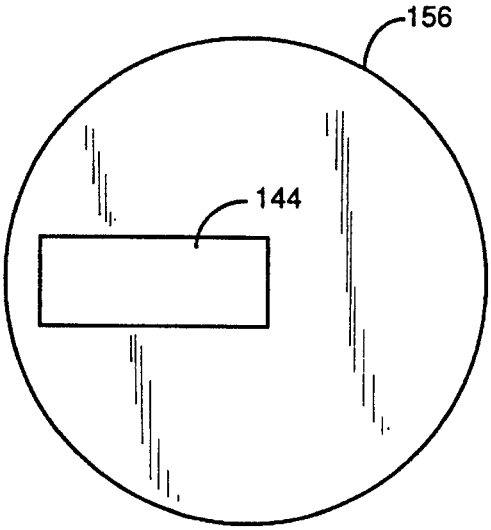

As is shown in FIG. 4 through 5*a*, the pedestal 36 has an elongated transversely oriented slot 144. The motor 124, and the shaft 140 (FIGS. 4–6) are secured to a panel 148 which is captively retained and movable within this slot in the directions indicated by the double arrow A in FIG. 5.

Figure 6:
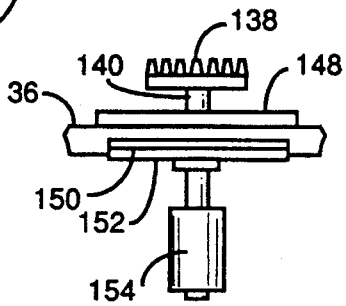
FIG. 6 is a fragmentary side elevational view of driven wheel assembly of a vehicle of the present invention.

Referring to FIG. 6, it is seen that the pedestal 36 in the region of the slot has a reduced thickness region 150 and a pair of panel elements 148, 152, which are secured to each other and cooperate to facilitate retention of the motor 124 and its associated gears along with driven wheel 154 as a subassembly transversely movable within slot 144. Panel element 148 is secured in spaced relationship with respect to panel element 152 and is larger than the slot 144 so as to keep the assembly captive while permitting relative sliding movement with slot 144. The driven wheel 154 as shown in FIG. 5 is positioned generally between the adjacent pair of spindles 94, 96. Preferably the shaft 140 bisects the distance between spindles 94 and 96. Electrical wires 160, 162 are connected to adjacent electrical pickups 102, 104 energizing lights 110 and 112 (FIG. 4).

The driven wheel 154 is resiliently urged toward the adjacent track side by any suitable means such as continuous rubber band 164 which is secured to post 166, which is secured to or formed integrally with pedestal 36 and is not part of movable panels 152, 148. A pair of screws 168, 178 are shown securing the two panel portions 152, 153 in the desired relative position.

Figure 7:
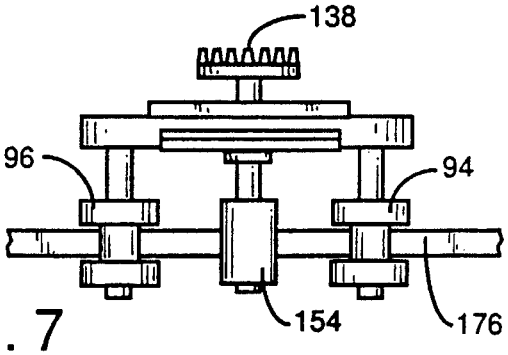
FIG. 7 is a fragmentary illustration of a portion of the vehicle of the present invention.

Referring to FIG. 7, there is shown a partial schematic illustration illustrating spindles 94, 96 engaging side 176 of the track means with driven wheel 154 being resiliently urged into contact with track side 176 or in the context of FIG. 7 being urged into the page. It will be appreciated that as electrical energy energizes motor 124, the output shaft 126 will rotate and through the engaged reduction gears 128, 138, will cause responsive rotation of shaft 140 which, in turn, will rotate driving wheel 154, thereby moving the vehicle along the track in a first direction. It will be appreciated that the rotatable spindles 90, 92, 94, 96 serve to maintain efficient mechanical interengagement between the track sides and the track while the driving wheel 154 serves to both drive the wheel and enhance contact as a result of the resilient bias of the wheel toward the track. It is preferred that the wheel be made of a durable, partially compressible material so as to enhance the interengagement with the track or, in the alternative, have a hard core with a compressible cover. This interengagement facilities efficient operation of the vehicle on the track regardless of whether the track is horizontally oriented, vertically oriented, on a curved climbing or descending portion, twisted or has a path which varies in contour or elevation. It will be appreciated that by reversing the electrical input, the vehicle may be caused to move in the reverse direction as the driven wheel 154 will rotate in the reverse direction.

Figure 8:
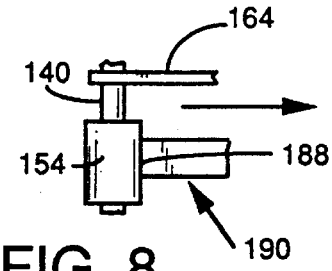
FIG. 8 is fragmentary illustration showing the driving wheel and associated track portion.

Referring to FIG. 8, there is shown the driven wheel 154 being urged into intimate contact with the side 188 of track means 190. Shaft 140 is being resiliently urged in the lateral direction shown by the arrow by resilient band 164 which may be a rubber band.

It will be appreciated that the pedestal 36 in the form illustrated is round in plan, although it may assume other configurations, if desired. It should be so dimensioned as to clear the inner surfaces of the hollow enclosure walls regardless of the configuration of the track. In a preferred embodiment, the enclosing hollow portions are preferably made of plastic as are the pedestal and the spindles. The electrical pickup may be made of copper or other electrically conductive materials. The motor may conveniently be a motor of the type used in model construction and may have a horsepower of about 1/17, for example.

Figure 9:
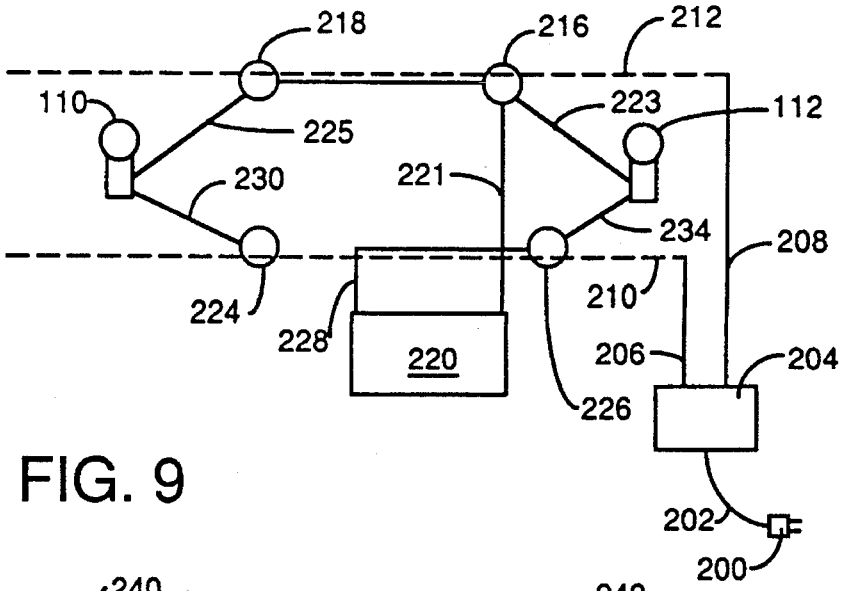
FIG. 9 is a schematic illustration of an electrical system of the present invention.

Referring to FIG. 9, a brief description of the form of electrical circuit useable in the present invention will be considered. The vehicle may be electrically energized by either a suitable battery such as a 9 volt battery or, as shown in FIG. 9, by means of a wall receptacle which receives a plug 200 which, in turn, is connected by wire 202 to a suitable transformer. A suitable transformer is the 120 volt, 60 Hz 110 VA transformer sold by Marklin under model designation 6727A. Wire 206 is electrically connected to individual track rail 210 and wire 208 is electrically connected to individual track rail 212. By means of the spaced overlying electrical pickups 216, 218, electrical energy from track 212 will be delivered to motor 220 by electrical lead and also to lights 110, 112 by leads 223, 225. Similarly, electrical pickups 224, 226 receive electricity from track 210 and deliver it to motor 220 by electrical lead 228 and to lights 110, 112 by leads 230, 234. If desired, a suitable on/off switch may be placed in the electrical line in order to avoid the need to either disconnect the battery or unplug the system when it is not in use.

Figure 10:
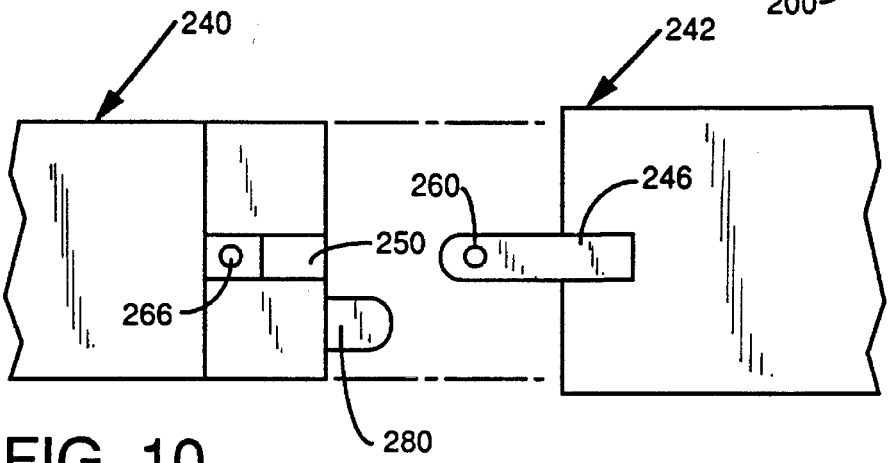
FIG. 10 illustrates two tubular sections which are to be joined to form a track assembly.

In the form shown, the individual tubular sections are shown as being substantially circular, although they may be provided with other shapes which facilitate joinder to establish a closed system, proper track support and adequate clearance for the vehicle. A suitable means for effecting joinder of the tubular members to which the track sections have been fixedly secured will be considered in connection with FIGS. 10–12. A first tubular member 242 has a pair of male projecting members 244, 246. They project generally in a direction parallel to the longitudinal axis of tubular member 242 (FIG. 12). Tubular member 240 has a corresponding pair of recesses 250, 252 within which the male members will be tightly received so as to effect intimate joinder so as to resist relative separating or rotating movement between sections 240, 242. To enhance retention, an opening 260 is provided in each of the male members 244, 246, and corresponding bosses 266, 268 which will be received in the opening 260 and corresponding opening (not shown) in element 244 so as to lock the two in place.

Figure 11:
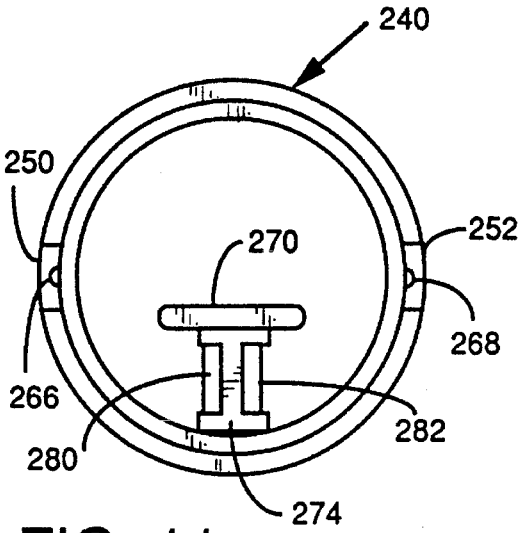
FIGS. 11 and 12 are respectfully elevational views of the two sections to be joined as shown in FIG. 10.
Figure 12:
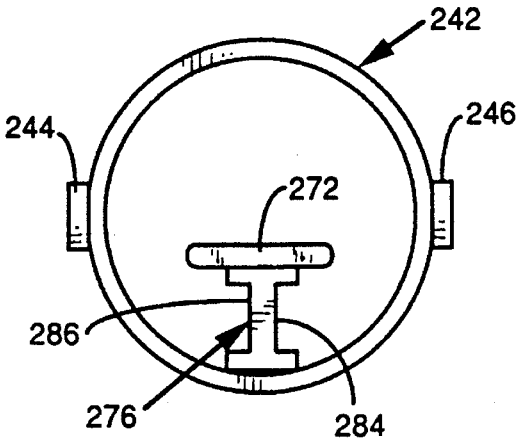
Figure 14:
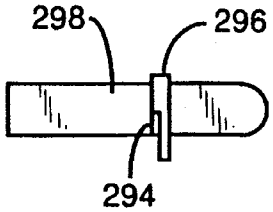
FIG. 14 is a front elevational view of a portion of a track to be joined in the present invention.
Figure 13:
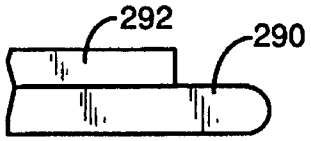
FIG. 13 illustrates a front elevational view of a male portion of a track joining member associated with the enclosure of the present invention.

Further enhancing securement as shown in FIGS. 11 and 12 are the track means 270, 272 and the underlying generally I-shape support means 274, 276, respectively. Tubular section 240 has a pair of spaced parallel forwardly projecting locking elements 280, 282 which engage opposed sides of beam portion 284, 286. Further enhancing locking action, as shown in FIGS. 13 and 14, are male projections of the metal rails which are received within recess 294 in metal track rail 296 which is a part of track means 298 of the other section to be joined.

Figure 15:
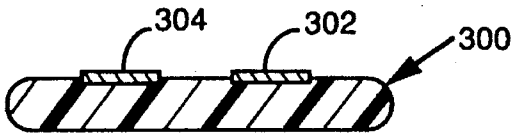
FIG. 15 illustrates a cross-sectional illustration of a modified form of track construction.

Referring to FIG. 15, an alternate form of track means 300 is provided wherein the electrically conductive track rails 302, 304 are shown as being generally horizontally oriented as distinguished from the embodiment shown in FIG. 2 wherein the track rails 34, 36 were generally vertically oriented.

Figure 16:
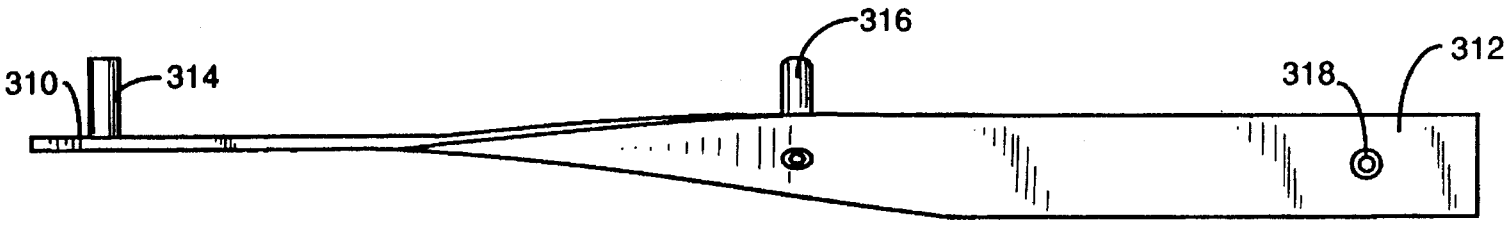
FIG. 16 is a form of twisted track of the present invention.

Referring to FIG. 16, there is shown a track which rather than conforming generally in longitudinal axis configuration to the shape of the section within which it is positioned is twisted. It will be noted that the track from end to end has a first portion at one end 310 in a generally horizontal position and the other end portion 312 being generally vertical. The vehicle of the present invention is designed to travel efficiently even on such a track configuration. Shown in this track portion are alternate means of support for the track undersurface wherein individual columns 314, 316, 318 are provided in lieu of the I-beam shaped continuous or semicontinuous members of the other embodiment. The columns have one end secured to the inner surface of the tubular members and the other secured to the track means undersurface.

Figure 17:
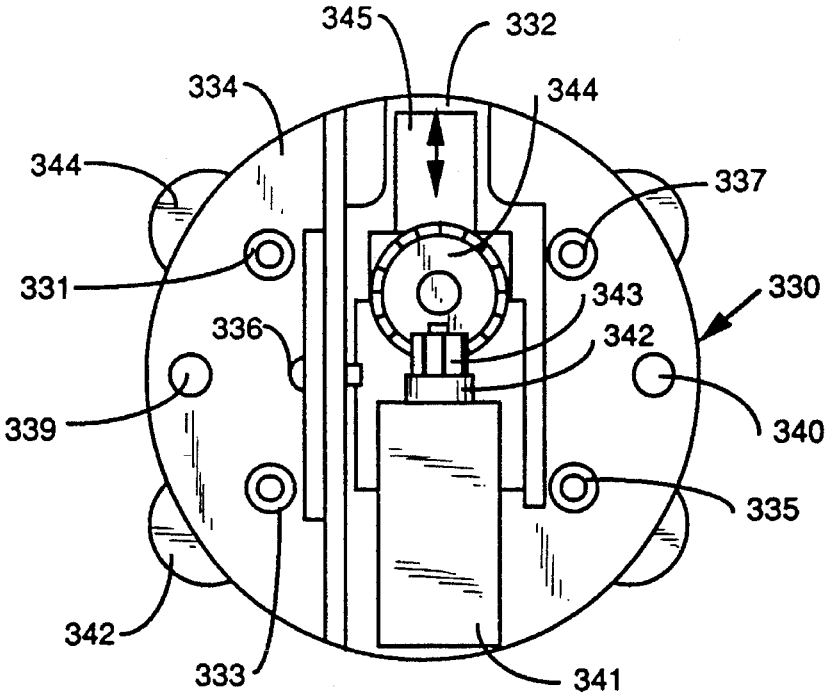
FIG. 17 illustrates a plan view of vehicle having articulated body parts.
Figure 18:
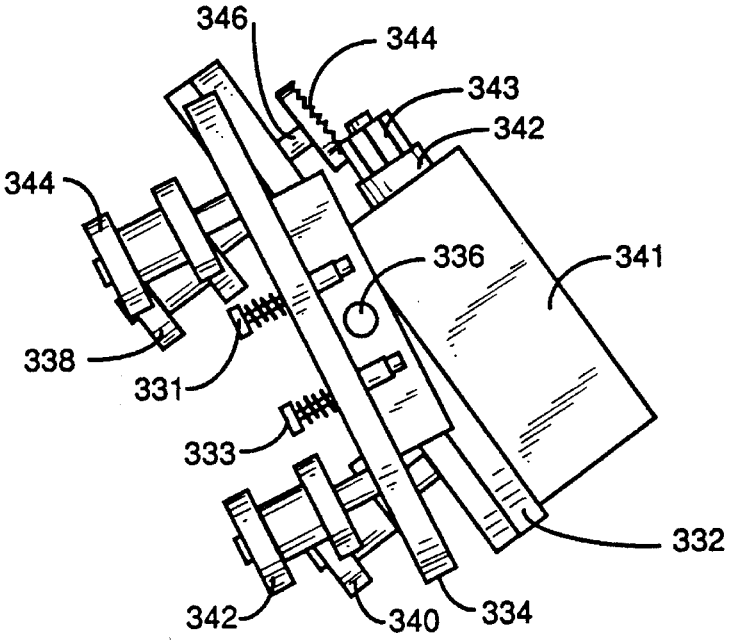
FIG. 18 is a side elevational view of the articulated vehicle of FIG. 18.

FIGS. 17 and 18 illustrate an alternate form of vehicle of the present invention. In this embodiment the pedestal 330 has a first section 332 and a second section 334 which are pivotally mounted with respect to each other as by a two-headed fastener 336. The axis about which the sections 332, 334 pivot is preferably generally parallel to the longitudinal axis of the hollow enclosure or the longitudinal axis of said track rails. This embodiment as shown in FIG. 18 shows the two pedestal portions in relative rotated position with the spindles 338, 340, 342, 344 in relative position to accommodate engagement with the twisted track means, for example.

The portions of the components described hereinbefore with respect to the embodiment having a unitary substantially rigid pedestal are also provided in this embodiment. The first section 332 has motor 341, which has output shaft 342, bevel gear 343, and interengaged crown gear 344, which rotates about a generally vertical axis. The slot 345 permits reciprocating movement of the panel which bears the motor and associated gearing, as well as the driven wheel (not shown) in the direction indicated by the arrow. Four electrical pickups 331, 333, 335, 337 are provided as are lights 339, 340.

Figure 19:
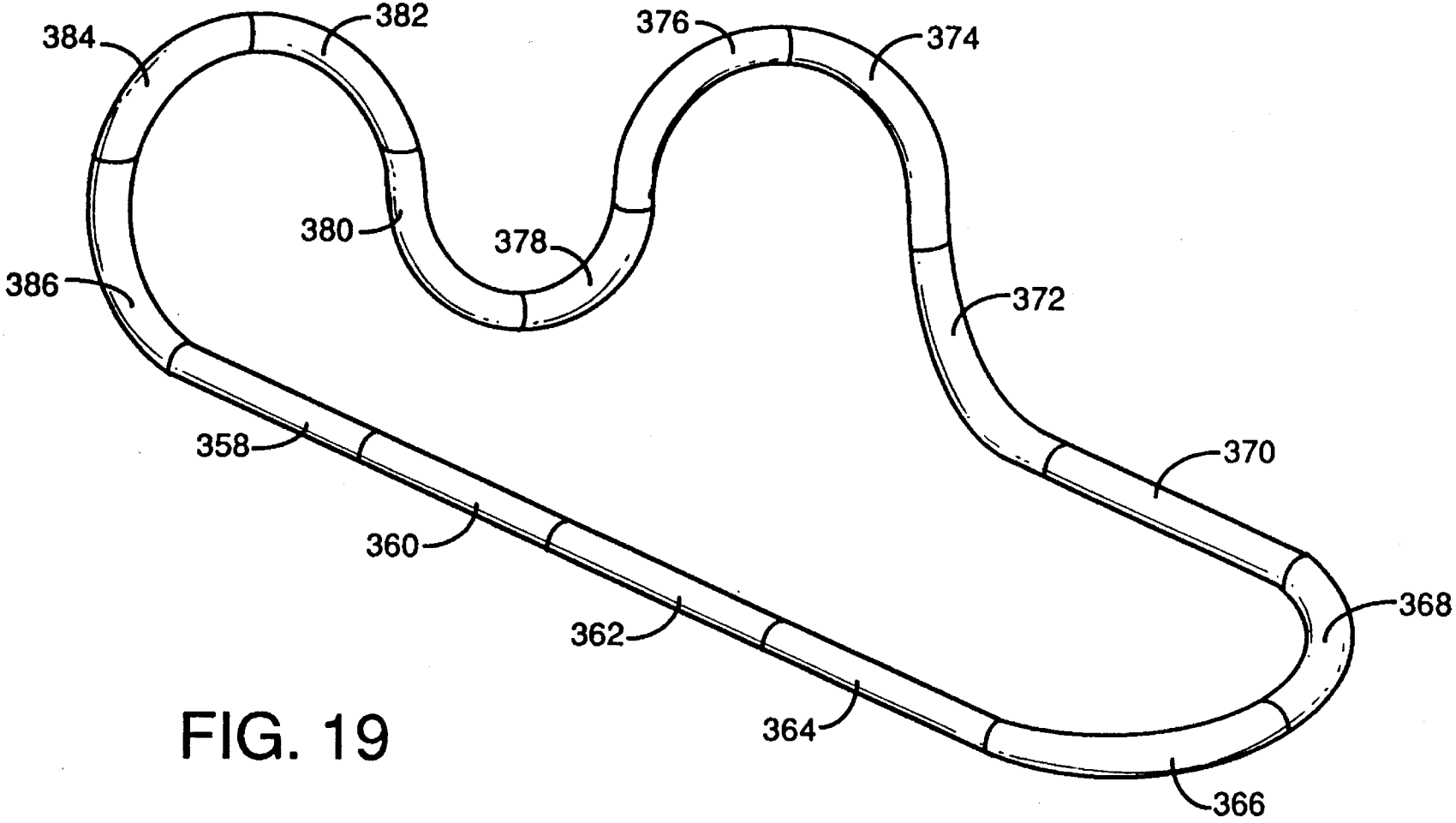
FIG. 19 is another example of an enclosed track assembly of the present invention.

FIG. 19 illustrates a form of closed track wherein several portions 358, 360, 362, 364, 370 are generally straight and portions 366, 368 are generally curved and horizontal. Portions 372, 374, 376, 378 disclose a first substantial climb in elevation and drop therefrom with sections 380, 382, 384, 386 showing a further climb and drop in elevation. It will be appreciated that many variations in terms of size and contour of closed enclosure may be provided.

Figure 20:
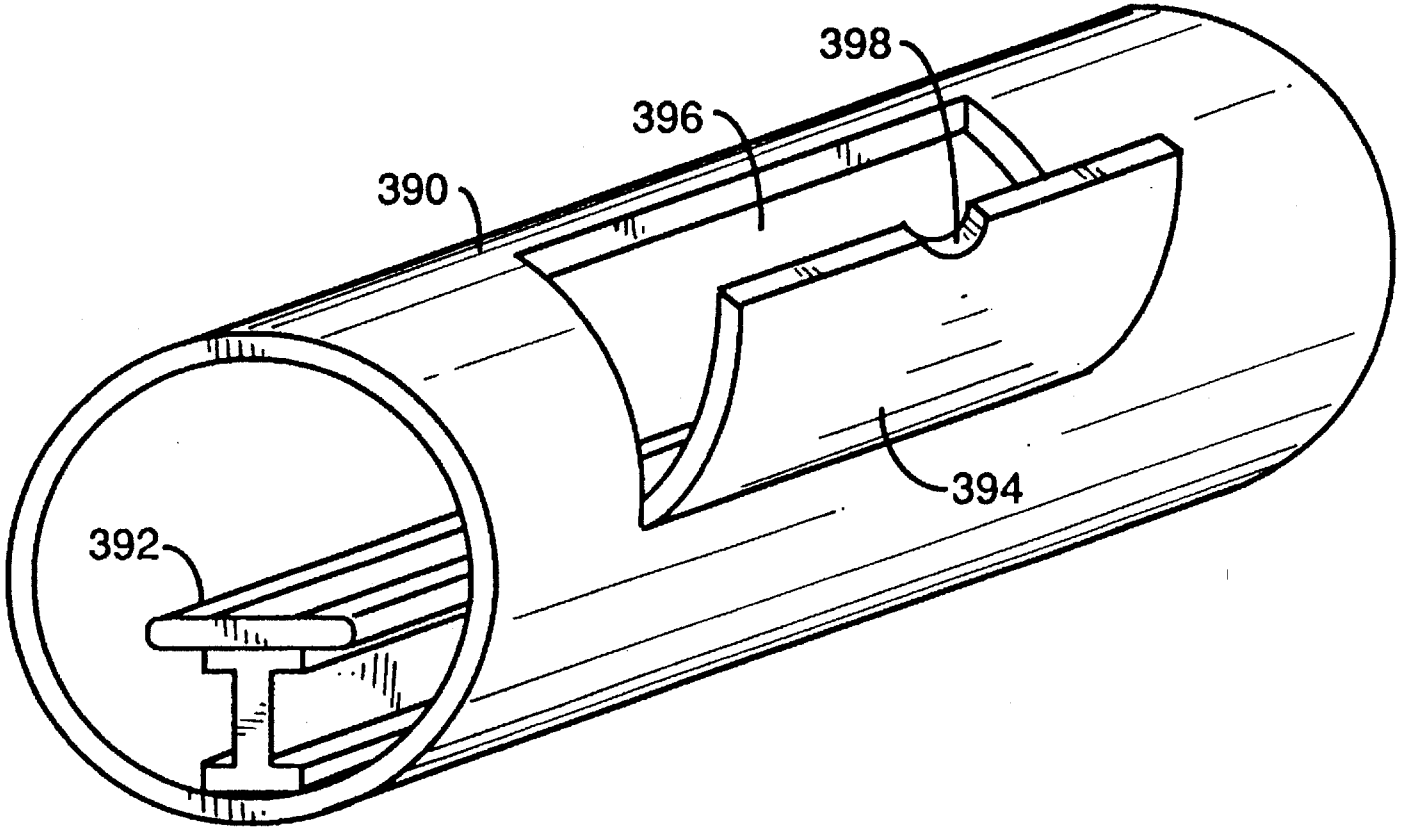
FIG. 20 is a perspective view of a track section having a tubular portion with a movable access hatch.

It will be appreciated that a preferred practice of the invention is to employ a closed hollow housing for the track to maintain track integrity as the tubular sections do not merely provide a cover, but rather contribute to strength of the assembly. If desired, the system may be used without such closure so long as adequate track support is provided. Also, if desired, for purposes of access, portions of the hollow closed sections may be eliminated or, in the alternative, as shown in FIG. 20, section 390 which has track means 392 therein, has a hinged access panel 394 which provides an opening 396 to gain access to the interior.

Figure 21:
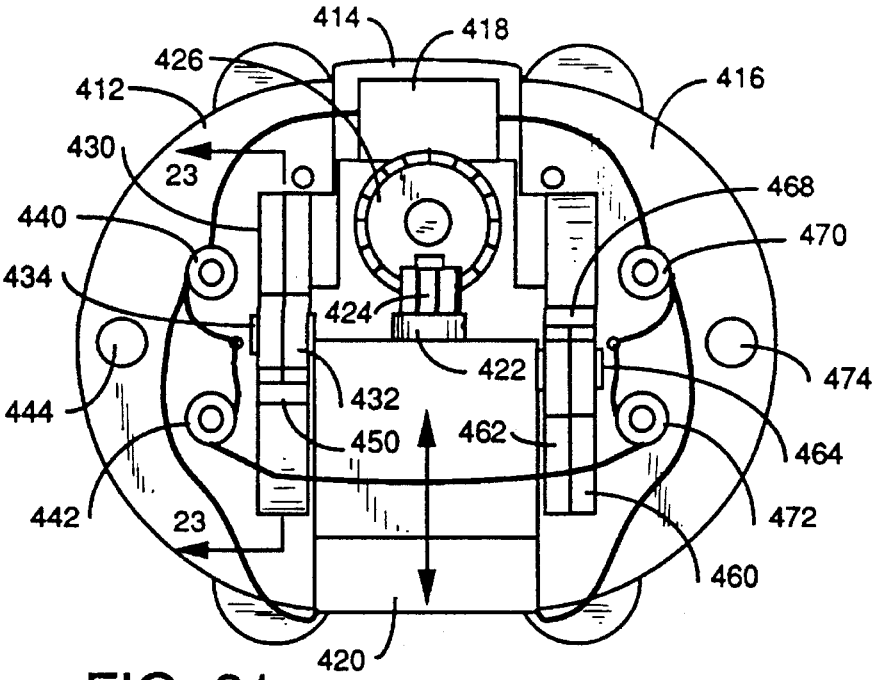
FIG. 21 is a top plan view of a modified form of vehicle having rotatable sections.
Figure 22:
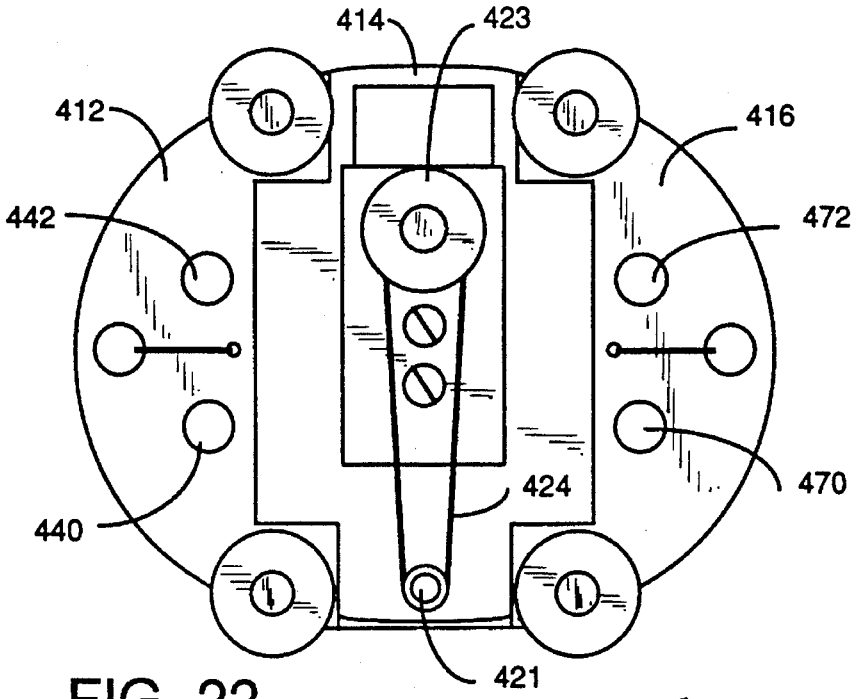
FIG. 22 is a bottom plan view of the vehicle of FIG. 21.
Figure 23:
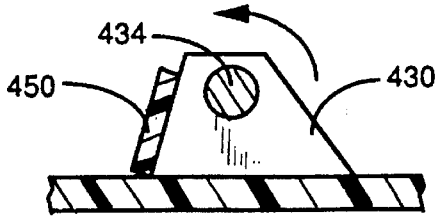
FIG. 23 is a cross-sectional view of a portion of the vehicle of FIG. 20 taken through 23—23.

The embodiment of FIGS. 21 through 23 involves a vehicle which has three pivoting sections 412, 414, 416. A slot 418 is provided in section 414 for reciprocating of the motor 420 in a similar manner to the other embodiments. The motor has output shaft 422, bevel gear 424, in engagement with crown gear 426, to which is fixedly secured a shaft (not shown) which is fixedly secured to driven wheel 423. Wall 430 of section 412 is pivotally secured to wall 432 of section 414 by means of two-headed stub shaft 434. Spring-biased electrical pickups 440, 442 are secured to section 412 as is light 444. Stop member 450 is secured to an end of wall member 432. It serves to limit the freedom of rotation of section 412 and wall 430 about pivot 434 in a first direction.

Similarly, section 416 has wall 460 on section 416 and wall 462 on section 414 with two-headed spindle shaft 464 serving as a pivot means. Stop means 468 is secured to an end of wall 462 to resist rotation of wall 460 in a direction opposite to the resistance provided by stop member 450 with respect to wall 430 on section 412.

Electrical pickup means 470, 472 are secured to wall section 416 and light 474 is also secured to section 416.

As shown in the bottom plan view of FIG. 22, resilient means, such as a rubber band 424 is in contact with fixed post 421 and serves to urge driven wheel 423 into intimate contact with an edge of the rail means.

It will be appreciated that in this manner the center section 414 and one end section 412 is associated in such a manner as to permit relative rotational movement of section 412 with respect thereto in a first direction with the stop means 450 serving to limit the freedom of travel. Section 416 is permitted to rotate with respect to section 414 in the opposite direction from the direction of rotation of section 412 with stop 468 providing a limitation of rotation. This permits the three section vehicle of FIGS. 21–23 to have enhanced ability to travel on tracks of varying contour.

It will be appreciated, therefore, that the present invention has provided a vehicle assembly and a uniquely configurated toy vehicle which is a portion thereof which permits the vehicle to be driven through paths which are not horizontal may include vertical portions, angular portions, axially twisted track portions curved portions and combinations thereof and of various orientations. All of this is accomplished through the unique vehicle track retention means and driving means and the associated electrical pickups. The closed tubular system is a preferred means of construction with individual sections being assembled to create the desired configuration.

While for purposes of illustration herein reference has been made to certain materials and dimensions, it will be appreciated that the invention is not so limited and a wide variety of dimensions and materials may be employed while maintaining the benefits of the present invention.

While for purposes of example, a vehicle dome, such as dome 40 in FIG. 2, has shown as a cover for the vehicle, such cover may take any desired shape and may be clear, translucent or solid.

For example, the cover could take the form of animal shapes, clowns, or other aesthetically appealing configurations. Also, if desired, the vehicle could have seats and passengers positioned therein.

While a unitary vehicle has been illustrated, it will be appreciated that, if desired, a series of unpowered vehicles could be secured to each other and to a powered vehicle as by a conventional ball and socket connection employed in full size vehicles. If desired, a powered vehicle may be placed at each end of the assembly of vehicles.

Reference herein to "upper," "lower," and similar terms related to relative position are employed for convenience of disclosure and are not limitations on the invention.

Whereas particular embodiments of the invention have been described herein, for purposes of illustration, it will be evident to those skilled in the art that numerous variations of the details may be made without departing from the invention as defined in the appended claims.

I claim:

1. A toy vehicle system comprising electrically energizable track means assembled from a plurality of track sections, power means for energizing said track, vehicle means having an electric motor and a motor output shaft, said vehicle means having track engaging means for resisting separation of said vehicle means from said track means, a resiliently biased driven wheel disposed in contact with said track means and being operatively associated with and rotatably responsive to rotation of said motor output shaft, said track means having a continuous path, said track means having two electrically conductive track rails, said vehicle means having at least one vehicle, said vehicle having a vehicle pedestal and a slot formed within said pedestal, a movable panel to which said motor and said driven wheel are secured, and said movable panel being secured within said slot to permit movement of said panel within said slot.

2. The toy vehicle system of claim 1 including said track means having a pair of lateral sides, and said track engaging means having at least two rotatable spindles interengaged with said track means lateral sides to resist separation of said vehicle from said track means.

3. The toy vehicle system of claim 2 including said spindles having an axially recessed portion with a height of about 1½ to 2½ times the thickness of the adjacent track means lateral side.

4. The toy vehicle system of claim 2 including first gear means fixedly secured to said motor output shaft, a driven wheel having a rotatable shaft fixedly secured thereto, and second gear means fixedly secured to said driven wheel rotatable shaft and in engagement with said first gear means.

5. The toy vehicle system of claim 4 including said first and second gear means co-acting to function as speed-reducing means.

6. The toy vehicle system of claim 2 including said track-engaging spindles being idler spindlers.

7. The toy vehicle system of claim 2 including said driven wheel being disposed generally midway between said two spindles engaging the same said track means lateral side as said driven wheel engages.

8. The toy vehicle system of claim 2 including engagement between said driven wheel and said track means and engagement between said spindles and said track means resisting undesired vehicle separation from said track means regardless of orientation of said track means.

9. The toy vehicle system of claim 8 including said driven wheel engagement being sufficient to resist vehicle movement when the system is not electrically energized regardless of track orientation.

10. The toy vehicle system of claim 1 including a closed hollow enclosure within which said track means is secured.

11. The toy vehicle system of claim 10 including said closed hollow enclosure being established by joinder of a plurality of individual hollow sections.

12. The toy vehicle system of claim 11 including at least some of said hollow sections having a nonlinear longitudinal axis.

13. The toy vehicle system of claim 12 including locking means for securing adjacent said hollow sections to each other.

14. The toy vehicle system of claim 13 including said locking means including male means on one said hollow section and co-acting female means on the other said hollow section for receiving said male means.

15. The toy vehicle system of claim 14 including said male means including at least two axially projecting male elements disposed at or adjacent to the wall of said hollow section, and said female means including two axially open recesses for receiving said male elements.

16. The toy vehicle system of claim 1 including said hollow sections being unitary tubular plastic sections having an internal diameter of about 2 to 4 inches.

17. The toy vehicle system of claim 11 including said closed hollow enclosure having some said hollow sections which are axially curved.

18. The toy vehicle system of claim 17 including said closed hollow enclosures having portions defined by a plurality of said hollow sections being of generally uniform curvature.

19. The toy vehicle system of claim 1 including said driven wheel being disposed exteriorly of a lateral side of said track means and in contact therewith, and resilient means for urging said wheel into intimate contact with said track side.

20. The toy vehicle system of claim 19 including said vehicle having at least two electrical pickups in contact with each said track rail, and said pickups being electrically connected to said motor.

21. The toy vehicle system of claim 20 including said vehicle having two said pickups for each said track rail.

22. The toy vehicle system of claim 21 including said electrical pickups being spring-biased into contacting position with respect to said track rails.

23. The toy vehicle system of claim 21 including said vehicle having light means energized through said electrical pickups.

24. The toy vehicle system of claim 19 including said resilient means including at least one continuous resilient band.

25. The toy vehicle system of claim 1 including said slot being oriented generally transversely with respect to said vehicle.

26. The toy vehicle system of claim 1 including said track means being twisted about an axis of rotation which is generally parallel to said track means.

27. The toy vehicle system of claim 1 including said vehicle having a two section pedestal with one section being rotatable with respect to the other.

28. The toy vehicle system of claim 27 including said vehicle having a first rotatable section to which a pair of said track engaging means are secured, and said vehicle having a second rotatable section rotatably secured to said first rotatable section and having a pair of said track engaging means secured thereto.

29. The toy vehicle system of claim 28 including said motor secured to a panel which is slidably secured to said second rotatable section.

30. The toy vehicle system of claim 29 including said first rotatable section and said second rotatable section each having a spring biased electrical pickup in contact with each said track rail.

31. The toy vehicle system of claim 29 including a closed hollow enclosure within which said track means is secured, and said first and second rotatable sections being pivotable about an axis disposed generally parallel to the longitudinal axis of said hollow enclosure.

32. The toy vehicle system of claim 29 including said vehicle having a three section pedestal with a center section being rotatably secured to two end sections, and said motor being secured to said center section.

33. The toy vehicle system of claim 32 including said end sections being rotatable about an axis oriented generally parallel to said track rails.

34. The toy vehicle system of claim 33 including first stop means for limiting rotation of a first said end section in a first rotational direction, and second stop means for limiting rotation of a second said end section in a second rotational direction.

35. The toy vehicle system of claim 34 including track engaging means and electrical pickups secured to each of said end sections.

36. A toy vehicle comprising a pedestal having depending track engaging means for engaging opposite sides of track means having two electrically conductive rails, a driven wheel depending from said pedestal in engagement with one side of said track means to drive said vehicle, a motor for driving said driven wheel, electrical pickup means for engaging each of said pair of track rails of said track means and electrically energizing said motor, whereby electrical energy delivered to said track rails will serve to energize said motor and move said vehicle along said track means, said track engaging means including a pair of freely rotatable spindles for each side of said track means, said driven wheel disposed intermediate a said pair of said spindles which are adapted to engage one side of said track means, said vehicle pedestal having an elongated transverse slot, panel means movably secured to said slot for relative movement therein, said motor being secured to said panel means and having an output shaft terminating in first gear means, and said driven wheel being fixedly secured to a shaft which is secured to said moveable panel and terminates in second gear means which are in engagement with first gear means.

37. The toy vehicle of claim 36 including said first and second gear means are speed reducing gear means.

38. The toy vehicle of claim 37 including light means secured to said pedestal, and means for electrically energizing said light means.

39. The toy vehicle of claim 38 including resilient means for urging said driven wheel into intimate contact with said track means.

40. The toy vehicle of claim 39 including said track engaging spindles having a recess of a height of about 1½ to 2½ times the thickness of the lateral sides of said track means with which it will be engaged.

41. The toy vehicle of claim 39 including said resilient means including a continuous resilient band.

42. The toy vehicle of claim 11 including cover means covering at least the portion of said vehicle above said pedestal.

43. The toy vehicle of claim 36 including said electrical pickup means having spring means for urging them into intimate contact with said tracks.

44. The toy vehicle of claim 43 including said electrical pickup means each having a tube which is electrically connected to said motor, and a shaft member slidable secured within said tube.

45. The toy vehicle of claim 36 including said pedestal having a center portion and at least one end portion rotatably secured thereto.

46. The toy vehicle of claim 45 including said vehicle having at least two said end portions.

47. The toy vehicle of claim 46 including stop means for limiting rotation of said end portions.

48. The toy vehicle of claim 45 including said motor being secured to said center portion.

49. The toy vehicle of claim 45 including said end portion being rotatable about an axis of rotation which is generally parallel to said track rails.

* * * * *

UNITED STATES PATENT AND TRADEMARK OFFICE

CERTIFICATE OF CORRECTION

PATENT NO. : 5,507,679

DATED : April 16, 1996

INVENTOR(S) : James G. Getsay

It is certified that error appears in the above-indentified patent and that said Letters Patent is hereby corrected as shown below:

Column 5, line 45, "153" should be --148--.

Signed and Sealed this

Eleventh Day of February, 1997

Bruce Lehman

*Attest:*

BRUCE LEHMAN

*Attesting Officer*

*Commissioner of Patents and Trademarks*